United States Patent [19]

Orova

[11] Patent Number: 4,727,851

[45] Date of Patent: Mar. 1, 1988

[54] MAGNETO IGNITION SYSTEM FOR AN INTERNAL COMBUSTION ENGINE

[75] Inventor: Josef Orova, Schwabach, Fed. Rep. of Germany

[73] Assignee: Robert Bosch GmbH, Stuttgart, Fed. Rep. of Germany

[21] Appl. No.: 926,636

[22] Filed: Nov. 3, 1986

[30] Foreign Application Priority Data

Nov. 26, 1985 [DE] Fed. Rep. of Germany ..... 3541737

[51] Int. Cl.[4] ..... F02P 3/06

[52] U.S. Cl. ..... 123/601; 123/149 C; 123/599

[58] Field of Search ..... 123/901, 599, 149 C; 310/704; 315/209 CD, 218

[56] References Cited

U.S. PATENT DOCUMENTS

| | | | |
|---|---|---|---|
| 3,576,183 | 4/1971 | Miyamato | 123/601 |
| 3,667,441 | 6/1972 | Cavil | 123/601 |
| 3,894,524 | 7/1975 | Burkett et al. | 123/601 |
| 3,963,015 | 6/1976 | Haubner et al. | 123/601 |
| 4,214,566 | 7/1980 | Nanja et al. | 123/149 C |
| 4,215,284 | 7/1980 | Zentmayer, Jr. | 123/601 |
| 4,270,509 | 6/1981 | Tharman | 123/149 C |
| 4,515,118 | 5/1985 | Haubner et al. | 123/149 C |
| 4,515,140 | 5/1985 | Enomito et al. | 123/601 |
| 4,538,586 | 9/1985 | Miller | 123/599 |

*Primary Examiner*—Raymond A. Nelli

*Attorney, Agent, or Firm*—Frishauf, Holtz, Goodman & Woodward

[57] ABSTRACT

To reduce spurious sparks, and then misfire of an ICE having a magneto with an E armature, upon approach of a magnet (23) in a pole wheel (13) to the leading leg (26) of the E core at high speed ranges of the ICE, the magnetic reluctance of the magnetic path which includes the leading legs (26, 26*a*) of the E core (14, 14*a*) is increased with respect to that of the magnetic path which includes the trailing core (25), so that the inductivity of the magnetic circuit including the leading leg is decreased. This can be achieved by providing a wider air gap (X) at the leading leg (26) than at the center leg (15) and the trailing leg (25) of the E core; or reducing the cross-sectional area, or effective magnetic cross-sectional area, e.g. by reducing the number of laminations of the core, at the leading leg or reducing the size of the pole shoe surface (27) facing an air gap which is the same for all legs. A uniform air gap facilitates assembly of the E core. An additional air gap (28) can be introduced in the magnetic circuit which includes the leading leg (26*a*).

12 Claims, 3 Drawing Figures

MAGNETO IGNITION SYSTEM FOR AN INTERNAL COMBUSTION ENGINE

Reference to related patent, assigned to the assignee of the present application, the disclosure of which is hereby incorporated by reference:

U.S. Pat. No. 3,963,015, Haubner et al.

Reference to related publications:

German Patent Disclosure Documents Nos.: DE-OS 33 25 275 and 27 30 002.

The present invention relates to a magneto ignition system for an internal combustion engine, and more particularly to a magneto ignition system in which a spark coil is wound on a magneto armature, the spark being produced by an electronic circuit by interrupting current flow through the primary winding.

BACKGROUND

Magneto-type ignition systems for an internal combustion engine are well known; the referenced patent, assigned to the assignee of the present application and the disclosure of which is hereby incorporated by reference, U.S. Pat. No. 3,963,015, Haubner et al, describes a magneto ignition system in which a magnet wheel is being rotated by the engine, for example a small internal combustion engine (ICE) of the type used for lawnmowers, chainsaws, and the like. The magnet wheel is magnetically coupled to an ignition magneto armature. As the magnet passes the pole shoes of the armatures, an alternating voltage is induced in windings on the armature. The alternating voltage is formed by a small negative half-wave, a main positive half-wave and a subsequent negative half-wave. The negative half-waves are applied via a rectifier arrangement to the primary current circuit, which includes an electronic ignition switch. The details of such a circuit are explained in the referenced U.S. Pat. No. 3,963,015. In an upper speed range, the smaller first half-wave is used to obtain an advance of the ignition instant, that is, to advance the ignition timing. The advance is not gradual, rising with speed, but, rather, jumping from a predetermined ignition timing to an advanced timing instant. As the speed of the ICE increases, the halfwaves, including the negative half-waves, increase. The speeddependent increasing half-waves control, via a control circuit, an ignition switching element, typically a transistor, when a predetermined primary voltage is reached.

It is frequently desirable to change the ignition timing in dependence on the speed of the ICE gradually, that is, with increasing speed to advance the ignition timing. This is preferred over the jump adjustment. It is known to determine the ignition instant by using a control circuit as described, for example, in German Patent Disclosure Document No. DE-OS 33 25 275. The there disclosed system does not utilize rectifiers to rectify the smaller negative half-waves, since ignition is carried out over the entire speed range of the ICE, and hence of the magneto, with the larger, positive half-waves. Magnetos having a magneto armature of generally E shape have a disadvantage, however, in that the smaller, negative half-waves, which occur in advance of the actual positive ignition half-wave, is considerable when the speed reaches its upper speed range. This negative half-wave which is also induced in the secondary winding may be sufficiently high so that the induction voltages cause sparks to flash over on the spark plug, resulting in far too advanced sparking and misfires.

It has been proposed to eliminate such misfires by damping the negative half-waves in the primary circuit. A suitable diode circuit and a serially connected resistor bridges the primary winding—see, for example, German Patent Disclosure Document No. DE-OS 27 30 002. Such an arrangement requires additional circuit elements, and substantially increases the power losses in the control circuit; additionally, by armature reaction, the beginning of the subsequent ignition half-wave is delayed.

THE INVENTION

It is an object of the present invention to provide an ignition circuit in which the ignition timing is changeable with changing speed of the engine, and in which, additionally, the effect of spurious, advanced ignition which may result in misfires, is avoided.

Briefly, the magneto armature, typically having an E-type core, is so constructed that the leading pole shoe or core leg has a lesser inductance than the trailing core leg. "Leading" and "trailing" as used herein refers to the direction of rotation of the magnet or magneto wheel, that is, the "leading" core leg is the one which is first influenced by the magnet when the magnet is rotated in the appropriate direction of rotation for which the ICE is designed.

The arrangement has the advantage that no additional circuit elements are needed; it is only necessary to so construct the magneto core for the magneto armature that the leading leg has a higher magnetic resistance than the trailing leg, so that the inductance of the leading leg is decreased. The inductance of the leading leg can be decreased in accordance with various design parameters and requirements. The magnetic flux which passes through the armature winding, as the magnet wheel approaches, and then passes by the leading leg, will be less than the magnetic flux as the magnet continues to rotate and passes by the trailing leg. The decreased magnetic flux at the leading leg so decreases the negative half-wave, which is in advance of the actual ignition half-wave, that no voltages will arise which may cause highly advanced ignition sparks, resulting in misfires at the spark plug, even at the highest speed ranges of the engine.

Various arrangements can be used to decrease the inductance of the magnetic circuit which includes the leading leg of the E core. In a particularly simple manner, the leading leg is constructed to have a wider air gap with respect to the rotating magnetic wheel than the remaining legs. It may be desirable for reasons of assembly to make the air gap of all three core poles the same; in that case, the leading leg may be formed with an additional air gap or the lower inductance at the leading leg can be obtained by decreasing the cross section of the leading leg with respect to the trailing leg. A particularly simple and effective solution is to use a pole shoe for the leading leg which is smaller than the pole shoe of the trailing leg.

DRAWINGS

DETAILED DESCRIPTION

Figure 1:
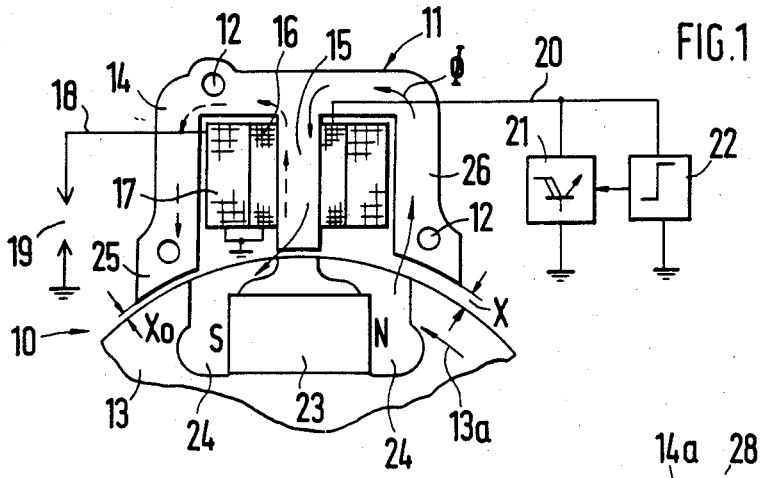
FIG. 1 is a fragmentary schematic diagram of a magneto ignition system, in which all elements not necessary for an understanding of the present invention have been omitted or are shown only schematically, and in which the air gap of the leading leg is increased with respect to the air gap of the trailing leg.

A magneto ignition system for an internal combustion engine (ICE) is shown in FIG. 1, generally at 10. It includes a magneto armature 11, formed with attachment holes 12, to be secured to a housing of the ICE (not shown). A rotary part of the ICE carries a magneto wheel 13—which may, additionally, form the flywheel of the engine. The magneto wheel 13 is secured to rotate with the ICE, for example by being directly attached to the drive shaft of the ICE. It rotates in the direction of the arrow 13a. The magneto armature 11 which, at the same time, forms the ignition coil, is a laminated stacked E core 14 having a center leg 15, a leading leg 26 and a trailing 25. A primary winding 16 and a secondary winding 17 are both wound on the center leg 15. The free end of the secondary winding 17 is connected over an ignition cable 18 with a spark plug 19, the second terminal of which is connected to ground or chassis of the ICE. The free end of the primary winding 16 is connected to a primary current circuit 20 which includes an electronically controlled ignition switching element 21, for example a transistor or the like. The ignition switching element 21 is controlled by a control circuit 22 to change state. The control circuit 22 is also connected to the primary winding 16. The second terminal of the primary and secondary windings 16, 17, like the spark plug 19, the ignition switching element 21 and the control circuit 22 are all connected to ground or chassis. The pole wheel 13 has a permanent magnet 23 cast therein which has pole shoes 24, for example of the shape shown in FIG. 1, and extending to the outer periphery of the pole wheel 13.

The center leg 15 of the core 14 as well as the trailing leg 25 have an air gap with respect to the pole wheel 13 of, for example, Xo=0.3 mm.

In accordance with the present invention, the inductance of the leading leg 26 is reduced with respect to the inductance of the trailing leg 25 and, as shown in FIG. 1, this is easily accomplished by changing the air gap between the pole wheel 13 and pole shoe formed by the leading leg 26. Thus, the air gap between the leading leg 26 and the pole wheel 13 has the dimension X=1 mm. The much wider air gap changes the magnetic resistance for the magnetic flux $\phi$, shown in solid-line arrows in FIG. 1, to be greater than the magnetic resistance for the flux coupling the trailing leg 25, and shown in broken-line arrows in FIG. 1. Thus, the inductivity of the leading leg 26 will be less than that of the trailing leg 25.

Figure 2:
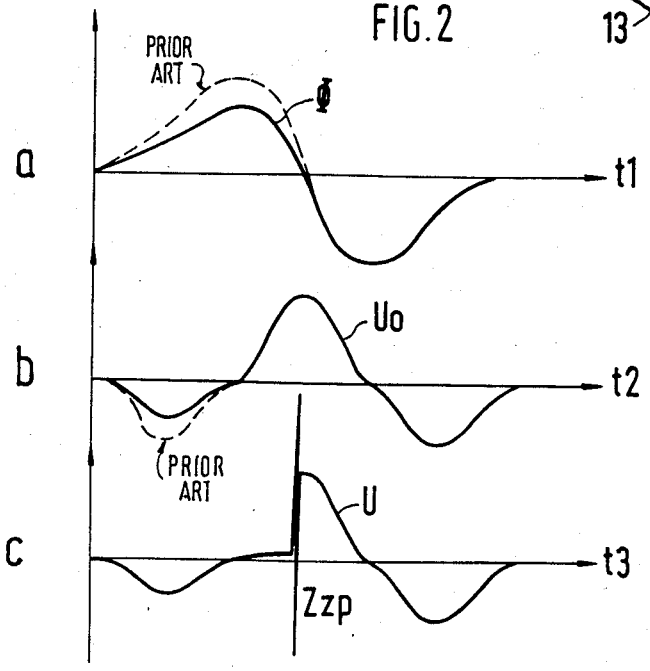
FIG. 2 is a series of graphs, to the same time axis, illustrating flux and voltage conditions arising at the magneto armature as a magnet of a magnet wheel passes the armature.

Operation, with reference to FIG. 2: The time axis t1, shown in graph a of FIG. 2, illustrates the flux in the primary and secondary windings 16, 17 of the armature 11. The pole wheel, rotating in the direction of the arrow 13, first causes an increase in the flux $\phi$ as the permanent magnet 23 or, rather, its pole shoes 24, approach the pole shoe of the leading leg 26, until maximum flux is obtained. This will occur approximately at the position shown of the pole wheel 13 in FIG. 1. The flux will then reverse, and the magnetic circuit will close, as indicated in broken lines in FIG. 1, over the trailing leg 25. The broken line in graph a of FIG. 2 illustrates the temporal course of the flux $\phi$ if the leading leg 26 would have an air gap Xo of 0.3 mm rather than the air gap X of 1 mm, as taught by the present invention.

Graph b, indicated by the time axis t2—which corresponds in time to the axis t1—illustrates the course of the no-load voltage Uo in the primary and secondary windings 16, 17. The wider air gap X at the leading leg 26 of the core causes a substantially lower negative half-wave than the half-wave which would be caused if the air gap at the leading leg 26 were the same as that of the trailing leg. This hypothetical, prior art condition is illustrated in broken lines in graph b.

Graph c, indicated by time axis t3 which corresponds, in time, to the time axes t1, t2, illustrates how the positive voltage half-wave, utilized for ignition of the magneto ignition system 10, first highly damped, since the primary circuit 20 through the ignition switching element 21 is effectively almost short-circuited. At the ignition instant Zzp, the ignition switching element 21 is blocked by the control circuit 22, which interrupts the primary current. This interruption causes a sudden voltage jump in the windings 16, 17, which results in a spark flash-over at the spark plug 19. After a short oscillatory period, the voltage returns to the no-load voltage, similar to the voltage as seen in graph b, which is induced by the flux change in the windings 16, 17 due to the continuously rotating pole wheel 13.

In accordance with the present invention, the wider air gap X at the leading leg 26 insures that the leading negative half-wave in the secondary winding 17 is decreased to such an extent that, even in upper speed ranges, this half-wave will be less than 2 kV, so that no spurious advanced ignition sparks can occur at the spark plug 19.

Figure 3:
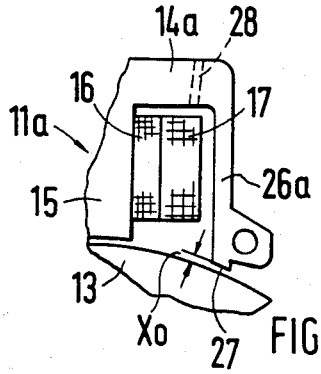
FIG. 3 is a fragmentary view illustrating another way of changing the inductance of the leading leg of the E armature core.

Various changes and modifications may be made and various arrangements can be used to decrease the inductivity of the magnetic circuit which includes the leading leg 26 of the E core. FIG. 3 illustrates a further way to reduce this inductivity or, to put it in other words, to increase the magnetic resistance or reluctance of the magnetic circuit at the leading leg 26*a* of the ignition armature 11*a*, shown only in fragmentary representation.

The leading leg 26*a* has a lesser cross-sectional area than the trailing leg 25. Additionally, the pole shoe surface 27, facing the pole wheel 13, is substantially less than the pole shoes of the legs 15 and 25. The air gap of Xo is the same for all three pole shoes, namely Xo=0.3 mm. This substantially facilitates assembly of the armature 11, since adjustment of the position of the armature requiring two different air gap measurements is no longer required. The reluctance of the magnetic path including the leading leg 26*a* can be further increased by introducing an air gap within the magnetic path including the leading leg 26*a*, as shown at 28 in FIG. 3. This air gap is not strictly necessary for all purposes; it may also be used in lieu of changing the cross-sectional area of the leading leg 26*a*. Of course, other changes may be made, for example the leading leg 26*a* of the core may be foreshortened or made narrower. Another way to reduce the inductivity of the leading leg is to reduce the number of core laminae for the leading leg, thereby increasing the reluctance of the magnetic flux path. Further, the leading voltage half-wave can be reduced by rounding or stepping the pole shoe surfaces at the leading leg. Any one of these changes may be used singly or in combination, in order to achieve a greater magnetic reluctance for the path including the leading leg. FIG. 3 is highly fragmentary, and the center leg 15 as well as the trailing leg 25 of the core 14*a* will be identical to the center leg 15 and the trailing leg 25 of the core 14 of FIG. 1. These elements have been omitted from the drawing of FIG. 3 for simplicty.

Various other changes and modifications may be made, and features described in connection with any one of the embodiments may be used with any of the others, or with the modifications disclosed, within the scope of the inventive concept.

I claim:

1. Magneto ignition system for an internal combustion engine having a magneto generator driven by the internal combustion engine (ICE) including a pole wheel having a magnet (23) thereon, driven by the ICE;

an ignition circuit armature core (14, 14*a*) of generally E shape, having a center leg (15) and—with reference to the direction of rotation of the ICE and hence of the pole wheel a leading leg (26, 26*a*) and a trailing leg (25);

a primary winding (16) and a secondary winding (17) wound on the core;

a spark plug (19) coupled to the secondary winding;

a controlled switching element (21) coupled to the primary winding (16);

a control circuit (22) coupled to the primary winding and controlling the switching element (21) to change state at an ignition instant determined by the control circuit, to thereby induce a high-voltage pulse in the secondary winding (17) and cause a spark at the spark plug (19), and comprising, in accordance with the invention, means to prevent spurious advance flash-over or spark at the spark plug as the magnet (23) on the pole wheel (13) passes the leading leg (26, 26*a*) of the core (14, 14*a*), including forming the leading leg (26, 26*a*) of the E core (14, 14*a*) to have a lower inductivity than the trailing leg (25) of the E core.

2. The system of claim 1, wherein the legs of the E core are spaced from the circumference of the pole wheel (13) by an air gap;

and wherein the air gap (X) of the leading leg (26) is wider than the air gap (Xo)

of the center leg and of the trailing leg (15, 25).

3. The system of claim 1, wherein the legs of the E core are spaced from the circumference of the pole wheel (13) by an air gap;

and wherein the leading leg (26) includes an additional air gap (28) therein.

4. The system of claim 1, wherein the leading leg (26*a*) has a lesser cross-sectional area than the trailing leg (25).

5. The system of claim 1, wherein the leading leg (26*a*) and the trailing leg (25) are formed with pole shoes;

and wherein the pole shoe surface (27) of the leading leg (26) is smaller than the pole shoe surface of the trailing leg (25).

6. The system of claim 1, wherein the effective magnetic cross-sectional area of the leading leg (26*a*) is smaller than the magnetic cross-sectional area of the trailing leg (25).

7. Magneto ignition system for an internal combustion engine having a magneto generator driven by the internal combustion engine (ICE) including a pole wheel having a magnet (23) thereon, driven by the ICE;

an ignition circuit armature core (14, 14*a*) of generally E shape, having a center leg (15) and—with reference to the direction of rotation of the ICE and hence of the pole wheel—a leading leg (26, 26*a*) and a trailing leg (25);

a primary winding (16) and a secondary winding (17) wound on the core;

a spark plug (19) coupled to the secondary winding;

a controlled switching element (21) coupled to the primary winding (16);

a control circuit (22) coupled to the primary winding and controlling the switching element (21) to change state at an ignition instant determined by the control circuit, to thereby induce a high-voltage pulse in the secondary winding (17) and cause a spark at the spark plug (19), and wherein, in accordance with the invention, to prevent spurious advance, flash-over or a spark at the spark plug as the magnet (23) on the pole wheel passes the leading leg (26, 26*a*) of the core (14, 14*a*), the magnetic circuit of the E core (14, 14*a*) which includes the center leg (15) and the leading leg (26, 26*a*) has a higher magnetic reluctance than the magnetic circuit which includes the center leg (15) and the trailing leg (25).

8. The system of claim 7, wherein the legs of the E core are spaced from the circumference of the pole wheel (13) by an air gap;

and wherein the air gap (X) of the leading leg (26) is wider than the air gap (Xo)

of the center leg and of the trailing leg (15, 25).

9. The system of claim 7, wherein the legs of the E core are spaced from the circumference of the pole wheel (13) by an air gap;

and wherein the leading leg (26) includes an additional air gap (28) therein.

10. The system of claim 7, wherein the leading leg (26*a*) has a lesser cross-sectional area than the trailing leg (25).

11. The system of claim 7, wherein the leading leg (26*a*) and the trailing leg (25) are formed with pole shoes;

and wherein the pole shoe surface (27) of the leading leg (26) is smaller than the pole shoe surface of the trailing leg (25).

12. The system of claim 7, wherein the effective magnetic cross-sectional area of the leading leg (26*a*) is smaller than the magnetic cross-sectional area of the trailing leg (25).

* * * * *